US006416408B2

(12) United States Patent
Tracy et al.

(10) Patent No.: US 6,416,408 B2
(45) **Date of Patent: *Jul. 9, 2002**

(54) METHOD OF PLAYING A GROUP PARTICIPATION GAME

(75) Inventors: Joseph J. Tracy, Westminster; Mark Guthrie Meyer, Phoenix, both of MD (US)

(73) Assignee: Anchor Gaming, Las Vegas, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/339,076

(22) Filed: Jun. 23, 1999

Related U.S. Application Data

(63) Continuation-in-part of application No. 09/106,659, filed on Jun. 29, 1998.

(51) Int. Cl.[7] ..... A63F 1/00

(52) U.S. Cl. ..... 463/16; 17/18; 17/19; 17/20; 17/21

(58) Field of Search ..... 463/16–22, 25–28; 273/269, 274, 139, 138.1, 138.2, 143 R, 454, 460

(56) References Cited

U.S. PATENT DOCUMENTS

| | | | | | |
|---|---|---|---|---|---|
| 5,112,050 | A | * | 5/1992 | Koza et al. | 273/139 |
| 5,116,049 | A | | 5/1992 | Sludikoff et al. | 273/139 |
| 5,186,463 | A | | 2/1993 | Marin et al. | 273/138 R |
| 5,232,221 | A | | 8/1993 | Sludikoff et al. | 273/139 |
| 5,273,281 | A | | 12/1993 | Lovell | 273/138 R |
| 5,380,007 | A | | 1/1995 | Travis et al. | 273/138 A |
| 5,393,057 | A | * | 2/1995 | Marnell, II | 273/85 CP |
| 5,401,024 | A | | 3/1995 | Simunek | 273/138 A |
| 5,451,052 | A | | 9/1995 | Behm et al. | 273/139 |
| 5,564,700 | A | * | 10/1996 | Celona | 463/27 |
| 5,770,533 | A | * | 6/1998 | Franchi | 463/42 |
| 5,772,509 | A | * | 6/1998 | Weiss | 463/16 |
| RE35,864 | E | * | 7/1998 | Weingardt | 463/28 |
| 5,830,063 | A | * | 11/1998 | Byrne | 463/18 |
| 5,833,537 | A | * | 11/1998 | Barrie | 463/21 |
| 5,996,997 | A | | 12/1999 | Kamille | 273/139 |
| 6,179,710 | B1 | * | 1/2000 | Sawyer et al. | 463/16 |
| 6,077,162 | A | * | 6/2000 | Weiss | 463/26 |
| 6,142,872 | A | * | 11/2000 | Walker et al | 463/16 |
| 6,217,448 | B1 | * | 4/2001 | Olsen | 463/25 |
| 6,227,969 | B1 | * | 5/2001 | Yoseloff | 463/13 |

OTHER PUBLICATIONS

Website entitled "Oregon Lottery Megabucks–How to play" last updated on Jul. 31, 2000 located at http://www.oregon-lottery.org/mega/m howto.htm.

* cited by examiner

*Primary Examiner*—Valencia Martin-Wallace
*Assistant Examiner*—Carmen D. White
(74) *Attorney, Agent, or Firm*—Marshall, Gerstein & Borun.

(57) ABSTRACT

A group wagering game is provided in which all entrants win or lose simultaneously as a group. The method of playing the game includes forming a group consisting of all entrants who have made a first wager on a first game and a second wager on the outcome of second group game. The outcome of the second group game is determined first, but is only applied if the first game is a winner. As such, a "bonus" round of play is provided which generates group interest and excitement in the gaming experience.

4 Claims, 3 Drawing Sheets

METHOD OF PLAYING A GROUP PARTICIPATION GAME

CROSS-REFERENCE TO RELATED APPLICATIONS

This application is a continuation-in-part of, and claims the benefit of, U.S. Pat. Application No. 09/106,659, filed Jun. 29, 1998.

STATEMENT REGARDING FEDERALLY SPONSORED RESEARCH OR DEVELOPMENT

"Not Applicable".

BACKGROUND OF THE INVENTION

This invention relates generally to games of chance, and more particularly to a method of playing a group wagering game in which all entrants win or lose simultaneously as a group.

In known wagering games, each individual entrant places a wager on the outcome of an event such as a roll of dice, a selection of one or more randomly generated indicia such as cards or numbers, a horse or dog race, a Jai Alai game, a sporting event, or the like, and the wager is won or lost depending on the outcome of the event. Typically, entrants are able to place their wagers on one or more of several possible outcomes of an event such that the actual outcome creates both winners and losers among the group of entrants of a particular game.

Some wagering games are designed around a particular apparatus such that the entrants must seek out a gaming table or machine in order to play. Other games can be played anywhere people are gathered and wagering is available. Regardless of the game being played or the venue in which it is presented for wagering, there is a need for a gaming method that will attract new entrants to wagering games and hold the attention of existing entrants so that such games remain attractive relative to the many new games and diversions constantly being developed.

Because the development of new games and diversions is costly and time consuming without any certain outcome of whether the game will be accepted by the gaming public, the use of a bonus feature on established and accepted games is desirable. Bonus features take many forms. For example, in U.S. Pat. No. 5,823,874 to Adams, a player may qualify for a bonus game on a gaming machine after achieving a predetermined winning outcome. Since this bonus feature is only available to those players who achieve the predetermined winning outcome, a player who has not achieved the bonus initiating winning outcome typically becomes bored and is more likely to cease playing the game. There is, therefore, a need to provide a bonus game in which a bonus or winning outcome is established prior to the initiation of the primary individual event and in which the bonus is awarded to all subsequent winning combinations of the primary event.

BRIEF SUMMARY OF THE INVENTION

Overcoming certain above-noted deficiencies in the known prior art, it is an object of the present invention to provide a simple wagering game that can be used in combination with existing games to generate and sustain player interest by offering a socially exhilarating group win environment around the game.

It is another object of the present invention to provide a wagering game that can be used as a stand alone game in which all entrants win or lose simultaneously as a group rather than as individuals, thereby enhancing group excitement.

Yet another object of the present invention to provide a group game that can be used in combination with existing games in which the prize amount awarded in the group game is determined irrespective of the initial amount wagered by a player in an individual game.

In accordance with these and other objects evident from the following description of the preferred embodiments of the invention, a first method of playing a group participation wagering game is provided, wherein the game includes the principle steps of forming a group consisting of all entrants who have made a wager on the outcome of the game, determining whether the group as a whole is a winner, and indicating the outcome of the game. Preferably, each entrant is able to make a wager that differs in size from the wagers being made by the other entrants, and the size of the winnings awarded to each entrant corresponds to the size of the entrant's wager. However, regardless of the amount of the wager placed by any entrant, all entrants in the group game win or lose together depending on the outcome of the game.

In accordance with another embodiment of the present invention, a second method of playing a group participation wagering game is provided, wherein the game includes the principle steps of forming a group consisting of all entrants who have made a wager on the outcome of the game, determining whether the group as a whole is a winner, and indicating the outcome of the game. Unlike the first embodiment, each entrant preferably makes the same wager as the other entrants and the size of the awards will correspondingly be equal. Again, all entrants in the group game win or lose together, and by varying the timing of the play of the group game in relation to another game, interest in the game increases.

A first embodiment of determining whether the group is a winner includes randomly generating indicia in an array and comparing at least a portion of the array with one or more predetermined winning combinations of indicia. As such, the entire group can watch the display of such indicia one-by-one, anticipating a win or loss and celebrating or mourning collectively. This social event adds to the enjoyment of the game and draws others to learn about the game and become entrants.

A second embodiment of determining whether the group is a winner includes randomly generating indicia in a display and comparing at least a portion of the display with predetermined indicia that represents a winning combination. Again, the entire group anticipates a win or a loss, increasing enjoyment of the game.

When used in combination with an individual participation game such as keno, bingo, slot machines, card games, dice games, sporting events and the like, the method of the present invention includes the steps of forming a group of at least some of the entrants in the first game, e.g. all players which make a wager, determining whether the entire group is a winner of the group game, and indicating the outcome of the group game. Again, use of the group game increases the enjoyment of the gaming entrants and draws new players to the games.

The award given in the group game is preferably in the form of a multiplier of the winning outcomes of another game, such that a player receives, for example, one times, two times, three times or any other multiple of his or her winnings in the other game. Alternatively, bonuses may be in the form of a fixed sum that is awarded upon a winning combination in addition to what was normally awarded for a winning combination in the other. However, if the outcome of the other game is not a winning combination, no award of the prize from the group game is made.

BRIEF DESCRIPTION OF THE SEVERAL VIEWS OF THE DRAWING

The preferred embodiment of the present invention is described in detail below with reference to the attached drawing, wherein.

DETAILED DESCRIPTION OF THE INVENTION

Figure 1:
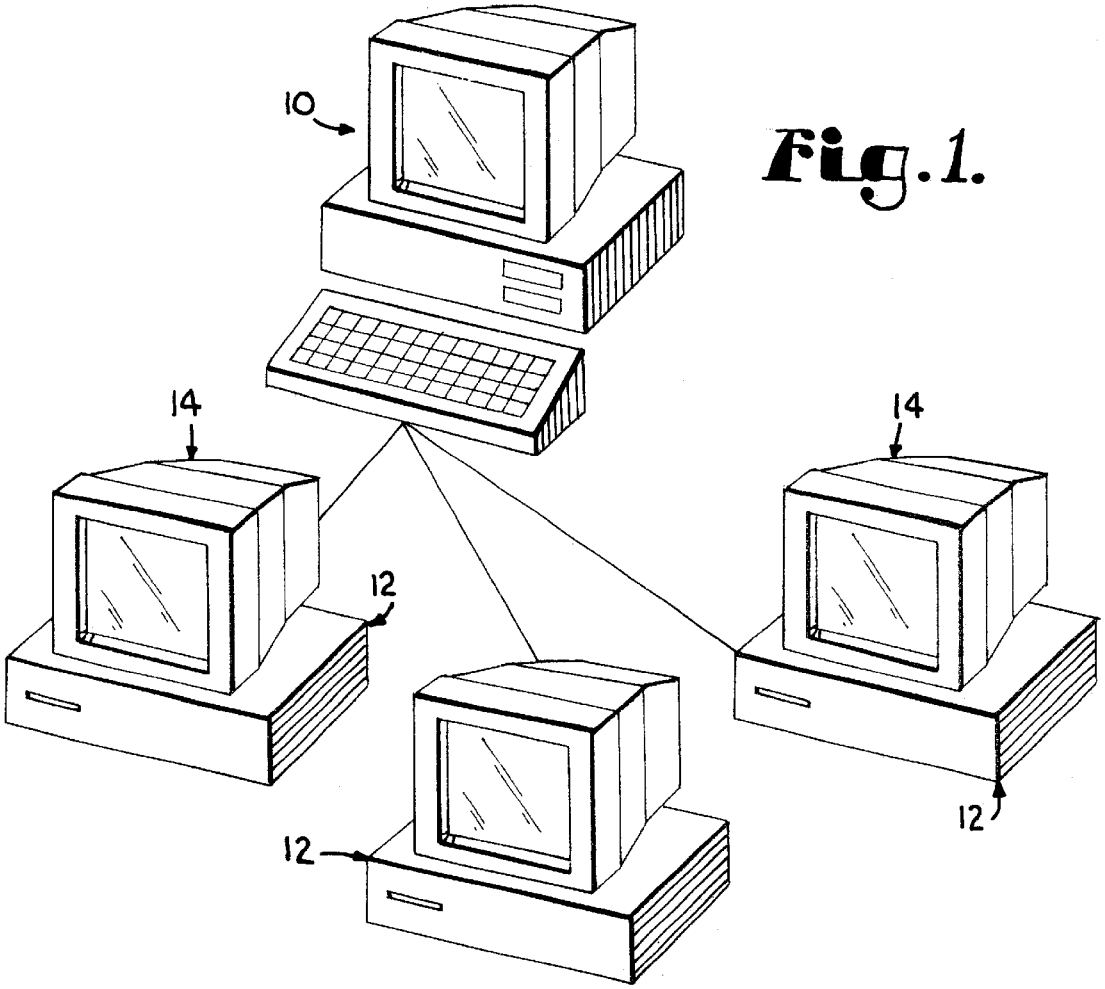
FIG. 1 is a schematic view of an apparatus for use in hosting a group wagering game in accordance with the preferred embodiment.

An apparatus capable of being used in hosting a group participation game in accordance with the preferred embodiment of the present invention is illustrated in FIG. 1, and includes a central processing unit 10 for generating random numbers or other indicia and transmitting the generated indicia to plural remote receivers 12, and a monitor or display 14 associated with each receiver for displaying the indicia and providing an indication of the outcome of the game. In addition, the receiver may form a part of a processing unit, such as a conventional interactive compact disk player or the like, for driving the display 14 so that entrants can observe the game in progress and witness the outcome thereof from various remote sites such as restaurants, taverns and gathering spots. Preferably, the central processing unit 10 includes software for generating the random numbers or indicia and for encoding the generated indicia for transmission to the various receivers, and the remote receivers associated with the displays include software for decoding the transmission and for driving the displays.

It is understood that the apparatus shown in FIG. 1 is provided for illustrative purposes only, and that the game of the present invention need not be hosted using any particular apparatus but may instead be carried out by any suitable electronic, mechanical or manual device as would be evident by a reading of the following description. For example, it is possible to employ a number generator in the form of a conventional blower-type apparatus adapted for use with ping pong balls, on which indicia are printed, for randomly generating the indicia, and a manual or mechanical display can be used at one or more locations to display the drawn indicia so that the group of entrants can monitor the progress of the game and determine whether the group is a winner or a loser. As such, the apparatus shown and described does not in any way limit the scope of the present invention, but merely represents one mode for carrying out the game.

Figure 2:
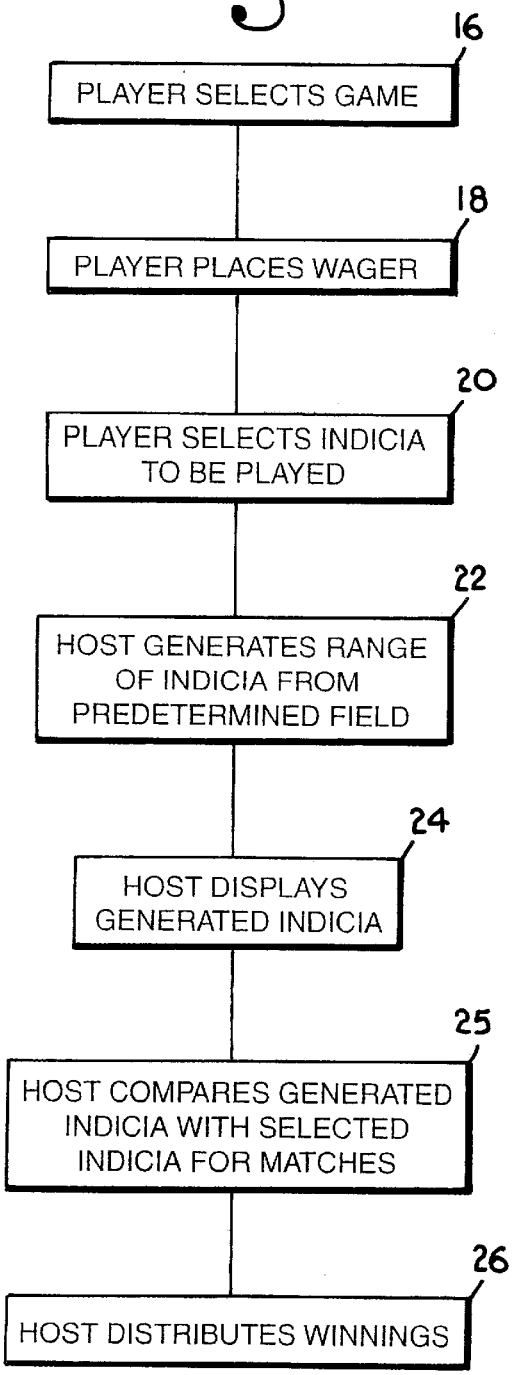
FIG. 2 is a flow chart of a method of playing a keno game to be used in combination with the group participation game.

In accordance with multiple embodiments of the preferred game, the group game is combined with an individual participation keno game. As shown in FIG. 2, the keno game is played by allowing entrants at 16 to select the number of "spots" to be played in a given game of keno, and at 18 to place a wager on the outcome of a random drawing of a predetermined range of indicia or numbers out of a large field, e.g. a drawing of 20 indicia out of a field of 80. If desired, an option may be provided whereby the entrant can allow the host to select his indicia automatically. At 20, the player selects the particular indicia or numbers to be played, and at 22 the central processing unit randomly draws the range of indicia from the field, and these indicia are encoded and transmitted to the various remote receivers where they are decoded and displayed, as at step 24. The individual entrants are thus able to watch as the generated range of indicia are displayed so that they can monitor their individual results and determine whether they are a winner or loser in the game. If they are a winner, they turn in their game card, which they filled out when placing their wager, and the indicia they selected are compared with the range for matches at 25.

If at least some of the numbers selected by the entrant are among the numbers in the range drawn from the field, the entrant wins a reward at 26. For example, the reward for selecting a single indicia that matches one of the 20 indicia drawn from a field of 80 might be $2, whereas the reward for selecting 10 indicia that match 10 of the 20 indicia drawn from the same field might be $100,000. If all of the numbers selected by the entrant are not among the range drawn from the field, a smaller percentage of correct selections wins. Thus, if an entrant selected 10 indicia and 5 of them match indicia drawn from the field, a prize of $2 might be rewarded.

Figure 3:
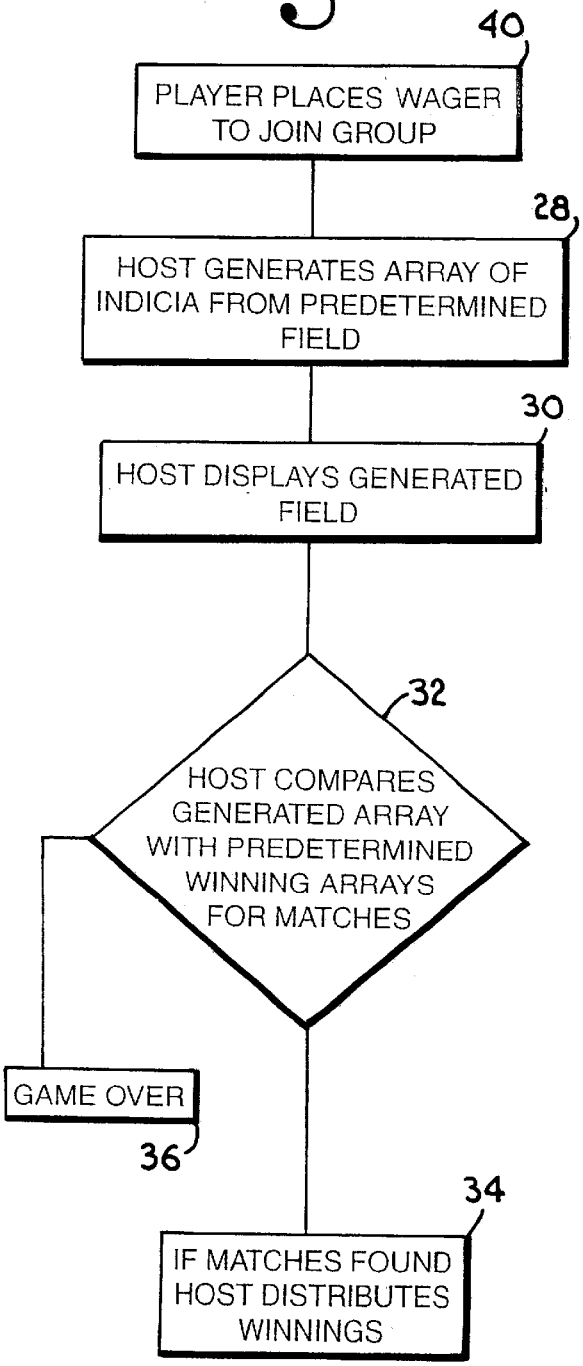
FIG. 3 is a flow chart of the method of the group participation game of the present invention.

The keno game is combined with the first embodiment group game of the present invention by allowing an individual to enter the group participation game at the same time he or she enters the keno game. For example, at 16, each entrant is given the opportunity not only to enter the keno game, but also to enter the group participation game, and at 18, an entry fee is paid for each of the games entered. Entrants are not required or allowed to make any selection or prediction of a particular winning combination, and all entrants have the identical odds of winning the game. If the group game is selected and a wager made, then after the keno game is over, the group game is played. With reference to FIG. 3, at 28, the same unit 10 used to play the keno game can be used to randomly generate indicia that is transmitted to the various receivers and displayed at 30. If a comparison of the generated indicia at step 32, reveals a match, then the group is a winner and each entrant is awarded a specified prize for each unit of his or her wager, as at 34. However, if no match is made, the group is a loser, as shown in step 36, and all wagers revert to the operator of the game.

Figure 4:
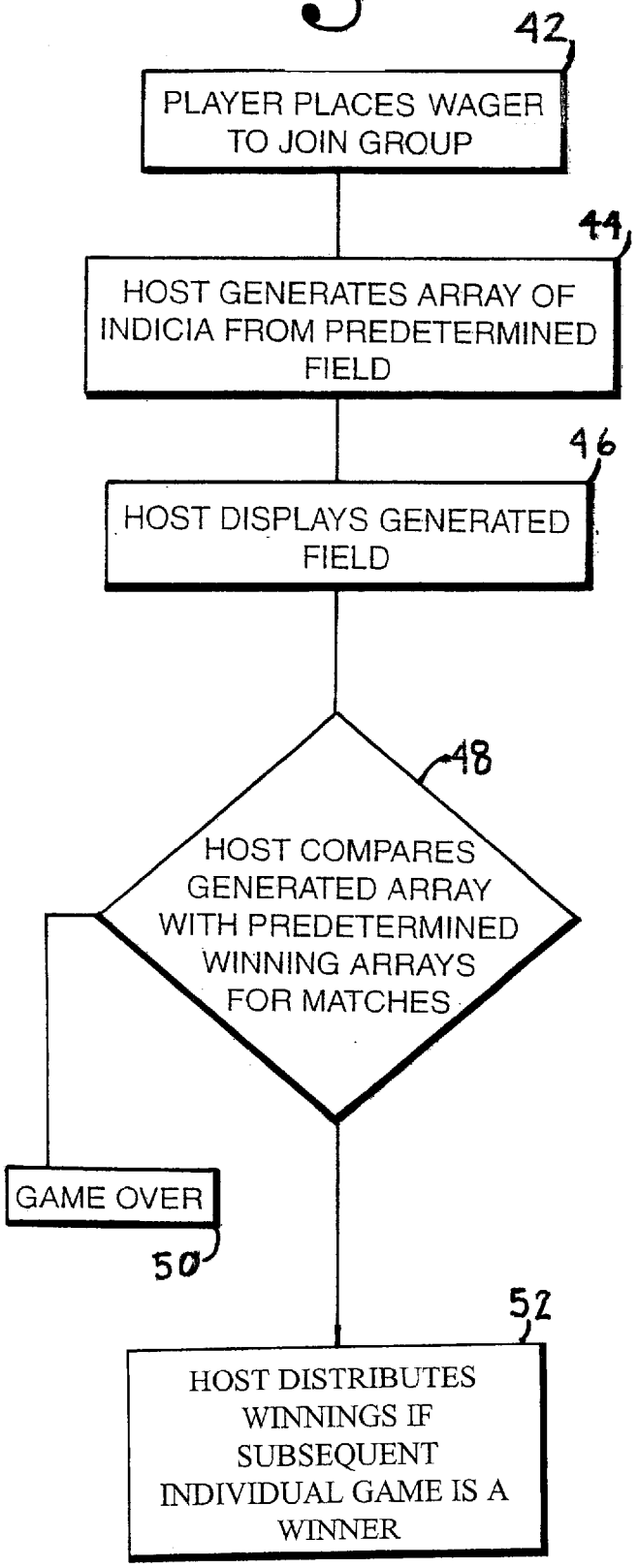
FIG. 4 is a flow chart of a method of the preferred group participation game.

Similar to the first embodiment, the keno game, described in FIG. 2 and explained above, is combined with the second embodiment group game by allowing an individual to enter the group participation game at the same time he or she enters the Keno game at 42. However, the bonus game is played prior to playing the individual game. With reference to FIG. 4 at 44, the same unit 10 used to play the keno game can be used to randomly generate indicia that is transmitted to the various receivers and displayed at 46. If a comparison of the generated indicia, at step 48, reveals a match, the group is a winner and each entrant is awarded the same prize if they have entered the wager and the entrant is a subsequent winner of the individual game as illustrated at 52. However, if no match is made, the group is a loser, as shown in 50, and all wagers revert to the operator of the game. Nevertheless, even if the entrant is a loser of the group game, he or she is still eligible to play and win the individual keno game.

Figure 5:
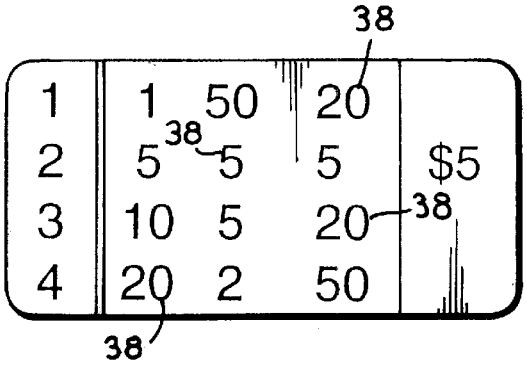
FIG. 5 is a plan view of a display indicating the outcome of a sample iteration of the group participation game.

A first embodiment of an exemplary display of the outcome of a group participation game is shown in FIG. 5, and includes an array made up of a plurality of rows and columns in which the randomly generated indicia 38 are displayed. Along the left side of the array are numbers indicating the game or row numbers in the array, and along the right side of the array is a column in which the winnings, if any, are displayed.

The indicia 38 generated and displayed in the group game preferably represent multipliers of the wager made by each player, and the odds of a given multiplier correspond to the magnitude of the multiplier. For example, if the multipliers 1, 2, 5, 10, 20 and 50 represent the field from which the range of indicia generated are to be selected, the odds of generating a 1 are far greater than those of generating a 50. One method employed to accomplish this weighted drawing is to employ a large field of numbers, and to assign each multiplier to a predetermined range of numbers, wherein the range of numbers assigned to the larger multipliers is substantially smaller than the range assigned to smaller multipliers. For example, if a field of 1000 numbers is used to generate the 6 multipliers noted, a multiplier of 1 would be generated if any number between 1 and 500 is drawn. Likewise, a multiplier of 2 would be generated if any number between 501 and 750 is drawn, a multiplier of 5 would be generated if a number between 751 and 850 is drawn, a multiplier of 10 would be generated if a number of between 851 and 900 is drawn, etc.

The multipliers generated during the game are displayed at random locations within the array, as dictated by the central processing unit, and are displayed one-by-one within the array so that all entrants can monitor the progress of the game and anticipate whether the group will win or lose. In the illustrated embodiment, the group wins if the three multipliers in any given row of the array match one another, and the group loses if the multipliers in all of the rows of the array fail to include all matching multipliers. Thus, as shown in FIG. 5, by generating the multiplier 5 for all three columns of row 2 of the array, winnings of $5 are awarded to all entrants who wagered on the group game.

In accordance with another aspect of the first embodiment of the outcome display of the game, the indicia 38 generated during the game can be numbers, pictures, playing cards, dice or other indicia representative of actual dollar amounts to be paid to all entrants, or they can be symbols or other indicia that must be arranged in a predetermined array or order to represent a winner for the group. In any event, a characteristic feature of the group game is the simultaneous observation of the game by all entrants gathered at each display so that a group excitement of anticipation is generated that draws people to the game and keeps their attention.

A second embodiment of the exemplary display outcome of a group participation game includes randomly generated indicia displayed to the players as payout multipliers on a wheel. To determine the outcome of the bonus game, the wheel is spun and the players anticipate whether a designator will point to a payout multiplier.

In an illustrative example, a wheel bearing 3, 4, 6 and 10 times payout multipliers is combined with a keno game. To qualify for the bonus round, a player indicates on the keno ticket that he or she wishes to participate in the group game and makes an additional wager. The wheel is spun and all the participants collectively anticipate whether the designator will point to a payout multiplier. For example, if the wheel lands on 3, then a player winning $10 in the keno game would collect $30. Likewise, if the wheel indicates 10, then the player collects $100. As would be understood, the indicia can take several forms including both mechanical and video representations.

Although the "bonus" nature of the game does not exist when it is offered independent of other games, it is possible to host the group game as a stand alone game. In order to play the game in this manner, a group is first formed at 40 of all individuals who enter the game by making a wager, a drawing is made at 28, and a determination is then made at 32, as to whether the group is a winner or loser. Thus, all entrants are able to simultaneously observe the game, and they win or lose as a group rather than as individuals. As with the combination game, none of the entrants is required or allowed to select indicia to play, but rather the entire group wins or loses with the same combinations, providing an environment in which every player is rooting for the same outcome as every other player.

Although the invention has been described with reference to the preferred embodiments illustrated in the attached drawing figures, it is noted that substitutions may be made and equivalents employed herein without departing from the scope of the invention as recited in the claims. For example, the group game can be employed in combination with games other than keno, such as bingo, a lottery, horse racing, dog racing, Jai Alai, table games, and gaming machines.

When the group game is combined with a bingo game, a separate blower is preferably provided along with predetermined quantities of bingo-type balls, wherein the numbers on the balls represent multipliers as described herein. A three-by-three array is displayed in which the randomly drawn balls are arranged, and the group of entrants in the game wins if the multipliers in any row, column or diagonal of the array match a predetermined winning combination. The group is formed of all entrants of the previous bingo game who made a wager on the outcome of the group game at the same time that they wagered on the bingo game.

When used in combination with a lottery game, the group game is conducted in conjunction with the lottery drawing in the same manner as it is conducted in combination with the keno game, with the group being formed of all entrants in the lottery who also made a wager on the outcome of the group game.

At the time an individual makes a wager on a dog race, horse race, Jai Alai game or other sporting event, they can also make a wager on a group game that is to be played during an intermission or between events. The group game is hosted as described herein, with multipliers or other indicia being generated and compared with a winning combination of indicia for a match. If such a match occurs, the group wins as a whole.

As gaming machines grow in popularity, and improvements to such machines are made, it is possible to provide a group gaming experience to individual players of such machines by combining the machine play with the group game of the present invention. An example of such a combination would include interrupting regular play of the machines at regular intervals in order to host a group game. Preferably, the group would include all machines that had maintained a predetermined level of play for the previous time interval such that this continued play would represent the wager required to enter the machine in the group game. Alternately, each player could be given the choice to either continue individual play or participate in a group game, the group for the group game would be formed of all those who indicated a desire to wager on the group game.

The particular game with which the group game is played can vary, as can the apparatus used to host the game and display the indicia being generated by the host. Such variations do not depart from the invention as claimed.

What is claimed is:

1. A method of playing a group participation wagering game in combination with an individual participation wagering game, the method comprising:

forming a group comprised of a plurality of entrants wherein each of said entrants has made a wager on an outcome of the individual participation wagering game and an additional wager to participate in the group participation wagering game;

determining whether a winning outcome is achieved in the individual participation wagering game wherein if a winning outcome is achieved in the individual praticipation wagering game, an individual prize amount is determined;

allocating a multiplier value to the group participation wagering game, said multiplier value allocated from a plurality of multiplier values capable of being applied to said individual prize amount, wherein each said entrant in the group partcipation wagering game who achieved a winning outcome in the individual participation wagering game is guaranteed to have said multiplier applied to said individual prize amount; and determining a total prize amount for each said entrant wherein each said entrant's total prize amount is equal to said entrant's individual prize amount multiplied by said multiplier value.

2. The method of claim 1 wherein a plurality of individual prize amounts are determine and each individual prize amount is multiplied by said multiplier value.

3. A method of playing a multiplier game in combination with a base game, said multiplier game being independent of said game, said method comprising:

making a wager on an outcome of the base game thereby enabling a player to participate in the multiplier game;

determining whether the outcome of the base game comprises a winning outcome for said player wherein a prize amount is determined when the winning outcome is achieved in the base game;

allocated a multiplier value to the multiplier game, said multiplier value allocated from a plurality of multiplier values capable of being applied to said prize amount, wherein said player of the multiplier game is guaranteed to have said multiplier value applied to a prize amount won in the base game; and determining a total prize amount for said player in the multiplier game wherein said player's total prize amount is equal to said prize amount won in the base game multiplied by said multiplier value.

4. The method of claim 3 wherein upon achieving a winning outcome in the base game, said player is guaranteed to have a multiplier value applied to said prize amount won in the base game irrespective of having achieved a winning outcome in the multiplier game.

* * * * *

UNITED STATES PATENT AND TRADEMARK OFFICE

CERTIFICATE OF CORRECTION

PATENT NO. : 6,416,408 B2 
DATED : July 9, 2002
INVENTOR(S) : Tracy, Joseph J. and Meyer , Mark G.

It is certified that error appears in the above-identified patent and that said Letters Patent is hereby corrected as shown below:

Column 7,
Lines 11-12, delete “praticipation,” and insert in its place -- participation --.
Line 18, delete “partcipation,” and insert in its place -- participation --.

Column 8,
Line 2, delete “determine,” and insert in its place -- determined --.
Line 3, before “game,” insert -- base --.
Line 10, delete “allocated,” and insert in its place -- allocating --.

Signed and Sealed this

First Day of June, 2004

JON W. DUDAS
*Acting Director of the United States Patent and Trademark Office*

US006416408C1

(12) EX PARTE REEXAMINATION CERTIFICATE (5314th)

United States Patent
Tracy et al.

(10) Number: US 6,416,408 C1
(45) Certificate Issued: Mar. 28, 2006

(54) METHOD OF PLAYING A GROUP PARTICIPATION GAME

(75) Inventors: Joseph J. Tracy, Westminster, MD (US); Mark Guthrie Meyer, Phoenix, MD (US)

(73) Assignee: JPMorgan Chase Bank, Houston, TX (US)

Reexamination Request:
No. 90/007,047, May 24, 2004

Reexamination Certificate for:

| | |
|---|---|
| Patent No.: | **6,416,408** |
| Issued: | **Jul. 9, 2002** |
| Appl. No.: | **09/339,076** |
| Filed: | **Jun. 23, 1999** |

Certificate of Correction issued Jun. 1, 2004.

Related U.S. Application Data

(63) Continuation-in-part of application No. 09/106,659, filed on Jun. 29, 1998, now Pat. No. 6,648,753.

(51) Int. Cl.
*A63F 9/24* (2006.01)

(52) U.S. Cl. ..... 463/16; 463/17; 463/18; 463/19; 463/20; 463/21

(58) Field of Classification Search ..... 463/16–22, 463/25–28
See application file for complete search history.

(56) References Cited

U.S. PATENT DOCUMENTS

| | | | | | |
|---|---|---|---|---|---|
| 4,805,907 | A | * | 2/1989 | Hagiwara | 463/26 |
| 4,836,553 | A | * | 6/1989 | Suttle et al. | 273/292 |
| 4,837,728 | A | * | 6/1989 | Barrie et al. | 463/27 |
| 4,861,041 | A | * | 8/1989 | Jones et al. | 273/292 |
| 5,393,057 | A | * | 2/1995 | Marnell, II | 463/13 |
| 5,848,932 | A | * | 12/1998 | Adams | 463/20 |
| 6,033,307 | A | * | 3/2000 | Vancura | 463/20 |
| 6,227,969 | B1 | | 5/2001 | Yoseloff | |
| 6,375,568 | B1 | * | 4/2002 | Roffman et al. | 463/26 |
| 6,648,753 | B1 | | 11/2003 | Tracy et al. | |
| 6,692,354 | B1 | | 2/2004 | Tracy et al. | |

OTHER PUBLICATIONS

Notices of Final Rulemaking, Arizona Administrative Register, vol. 6, Issued #13, Mar. 24, 2000.
www.oregonlottery.org., Oregon Lottery Web Center, Oregon Lottery, Apr. 30, 2004.

* cited by examiner

*Primary Examiner*—Michael O'Neill

(57) ABSTRACT

A group wagering game is provided in which all entrants win or lose simultaneously as a group. The method of playing the game includes forming a group consisting of all entrants who have made a first wager on a first game and a second wager on the outcome of second group game. The outcome of the second group game is determined first, but is only applied if the first game is a winner. As such, a "bonus" round of play is provided which generates group interest and excitement in the gaming experience.

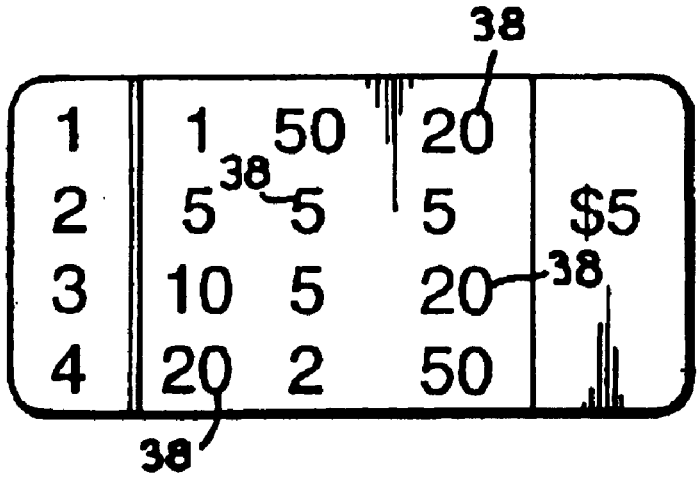

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–4 is confirmed.

* * * * *